United States Patent [19]

Giamattei

[11] Patent Number: 4,986,001

[45] Date of Patent: Jan. 22, 1991

[54] ADJUSTABLE TELESCOPE MOUNT FOR AN ARCHERY BOW

[76] Inventor: Frank J. Giamattei, 34 Shipp St., Newburgh, N.Y. 12550

[21] Appl. No.: 482,341

[22] Filed: Feb. 20, 1990

[51] Int. Cl.[5] ..... F41G 1/38

[52] U.S. Cl. ..... 33/265

[58] Field of Search ..... 33/265, 281, 285, 290, 33/292; 124/87, 24 R, 23 R, 88

[56] References Cited

U.S. PATENT DOCUMENTS

| | | | |
|---|---|---|---|
| 3,266,149 | 8/1966 | Powell | 33/265 |
| 3,284,904 | 11/1966 | Rade | 33/265 |
| 4,185,917 | 1/1980 | Alsina | 248/481 X |
| 4,528,973 | 7/1985 | Rasmussen | 33/265 X |
| 4,647,434 | 3/1987 | Ayers et al. | 248/288.3 X |

FOREIGN PATENT DOCUMENTS

| | | | |
|---|---|---|---|
| 949033 | 2/1964 | United Kingdom | 248/481 |

*Primary Examiner*—Harry N. Haroian
*Attorney, Agent, or Firm*—Heslin & Rothenberg

[57] ABSTRACT

The structure of an adjustable telescope mount for an archery bow has been presented herein. The main components of the present invention include: a threaded rod having a first and second end, a ball having a threaded hole therethrough, and means for adjustably clamping the ball. The first end of the threaded rod is capable of receiving a telescope and the second end is threaded through the hole in the ball, which is sized to receive the second end. The means for adjustably clamping the ball include two C-shaped members which have machined edges in order to have surfaces contoured to mate closely with the shape of the ball. The C-shaped members are attached to each other forming an opening which engages the ball. One of the C-shaped members is further attached to means for affixing the adjustable clamping means to the bow.

18 Claims, 3 Drawing Sheets

16
10
14
11b
11a
12

ADJUSTABLE TELESCOPE MOUNT FOR AN ARCHERY BOW

BACKGROUND OF THE INVENTION

1. Technical Field

The present invention relates to telescope mounts for archery bows and, more particularly, to a telescope mount for an archery bow which can be adjusted in three dimensions.

2. Description of Prior Art

Aiming devices, such as telescopes, have conventionally been used with archery bows in order to provide greater accuracy. Such aiming devices have been secured to archery bows by mounts, such as those described in U.S. Pat. Nos. 4,553,338 and 4,616,623.

The telescope mount described in U.S. Pat. No. 4,616,623 uses a sight mounting plate and three brackets including a bow mounting bracket, a sliding bracket, and an intermediate bracket. The desired direction of the telescope determines which bracket needs to be adjusted. If a vertical adjustment is necessary, then mounting slots and fasteners used to affix the mounting bracket to the bow are positioned so that the bracket is vertically adjusted with respect to the bow. If a lateral adjustment is necessary, then a fastener associated with the sliding bracket is loosened in order to adjust the sliding bracket to a predetermined position with respect to the bow mounting bracket. Next, if an angular adjustment is necessary, then a threaded fastener associated with the intermediate bracket is loosened thereby permitting the intermediate bracket to be rotated through a limited angular range with respect to the bow mounting bracket about a horizontal axis. Finally, if further adjustment is still necessary, a fastener associated with the sight mounting plate is loosened in order to enable the sight mounting plate to be rotated through a limited range with respect to the intermediate bracket about an axis perpendicular to the horizontal axis.

In using bow sights, it is important for the bow sight to be readily adjustable in order to accommodate a particular individual and/or a particular situation. One process presently employed for adjusting a bow telescope mount is summarily described in the foregoing paragraph. That process requires, as explained, a different procedure for each type of adjustment desired, which is inherently cumbersome and time-consuming. Therefore, a need still exists for a readily adjustable mount, which is capable of comfortably and conveniently positioning a telescope but still offers accuracy and good fine tuning capabilities.

SUMMARY OF THE INVENTION

Accordingly, a principle object of the present invention is to provide a telescope mount for an archery bow which is easily and readily adjustable in any direction.

It is a further object of this invention to provide a telescope mount for an archery bow which offers the capability of comfortably and conveniently positioning a telescope.

It is a further object of this invention to provide a telescope mount for an archery bow which is compact and less cumbersome and time consuming to adjust than prior art devices.

It is still a further object of this invention to provide a telescope mount for an archery bow which is infinitely adjustable within a predetermined range to provide greater accuracy.

The main components of the present invention include: a threaded rod having a first end, which is capable of receiving a telescope, and a second end; a ball having a threaded hole therethrough, which is sized to receive the second end of the threaded rod; and means for adjustably clamping the ball. Such clamping means is adapted to being attached to an archery bow. When these components are assembled in a manner such that the first end of the threaded rod engages the telescope and the second end engages the ball and the ball is clamped by the adjustable clamping means and the adjustable clamping means are secured to the bow, then the telescope has the capability of being adjusted in three dimensions relative to the bow.

In an enhanced version, the clamping means includes a first C-shaped member and a second C-shaped member, both of which have a partial spherical opening on one side. When assembled, the sides of these members having the partial spherical openings are engaged in an abutting relation so as to form an opening sized to receive the ball. Further, in an enhanced version, the invention includes means for affixing the adjustable clamping means to an archery bow. Such means for affixing includes a bracket which has a base plate, an arm extending from the base plate, and two slots in the base plate.

This invention allows an archer to easily adjust the telescope mount to fit the archer's needs. A gross adjustment is available by vertically adjusting the bracket relative to the bow. This is easily accomplished by positioning the slots where desired over the pre-existing holes in the bow.

Fine adjustments are also easily attainable. A transverse adjustment relative to the bow may be accomplished by simply loosening two nuts on the threaded rod and turning the rod.

Another fine adjustment may be made by loosening the two bolts penetrating the C-shaped members and rotating the ball. This permits an infinite three dimensional rotation within the ball's spherical range.

As can be seen from the foregoing and the remaining portions of the specification which follow, adjusting the telescope mount, as depicted herein, is easily accomplished by loosening two screws. With this invention, an archer may readily adjust the telescope mount in a comfortable and convenient manner to fit the archer's needs.

BRIEF DESCRIPTION OF THE DRAWINGS

The subject matter which is regarded as the invention is particularly pointed out and distinctly claimed in the concluding portion of the specification. The invention, however, as to structure, together with further objects and advantages thereof, may best be understood by reference to the following description taken in conjunction with the accompanying drawings in which:

DETAILED DESCRIPTION OF THE INVENTION

Figure 1:
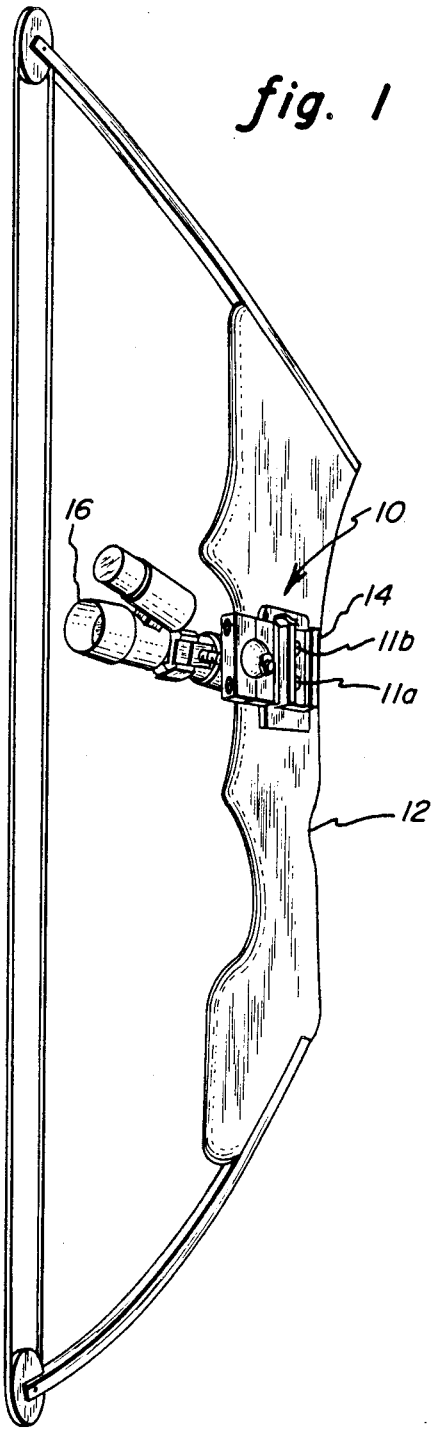
FIG. 1 is an illustration of one embodiment of an adjustable telescope mount of the present invention securing a telescope and attached to a conventional archery bow.

One embodiment of the present invention is illustrated in FIG. 1. The adjustable telescope mount (10) is designed to be mounted to an archery bow (12). Attached to telescope mount (10) is a conventional bow telescope, such as a pistol telescope (16). This type of telescope is frequently used with archery bows since it is compact, e.g. approximately five inches in length. If desired, a conventional quiver holder (14) may be attached to telescope mount (10) without any necessary modifications to the telescope mount, as described further below.

Figure 2:
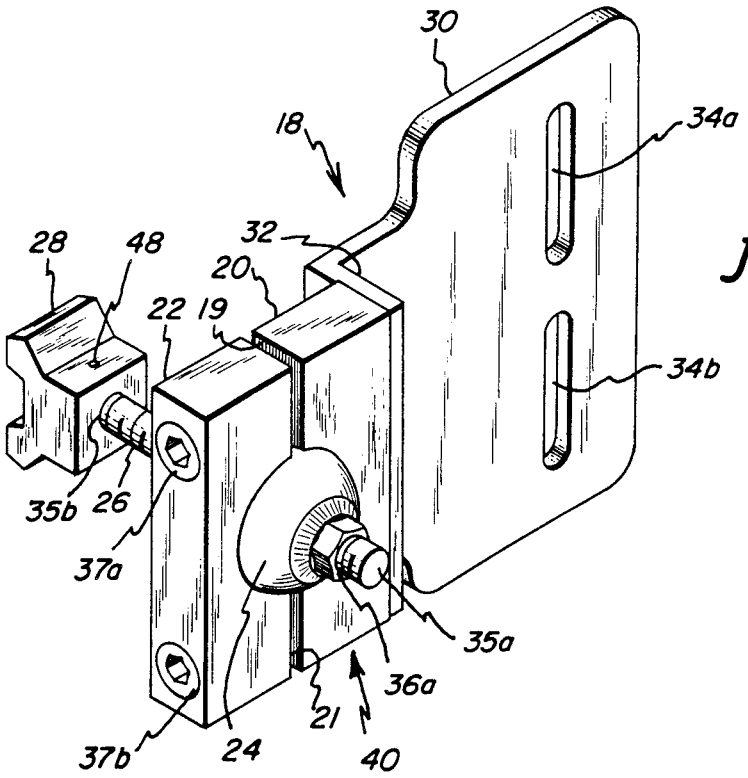
FIG. 2 depicts an assembled view of the telescope mount of FIG. 1.
Figure 3:
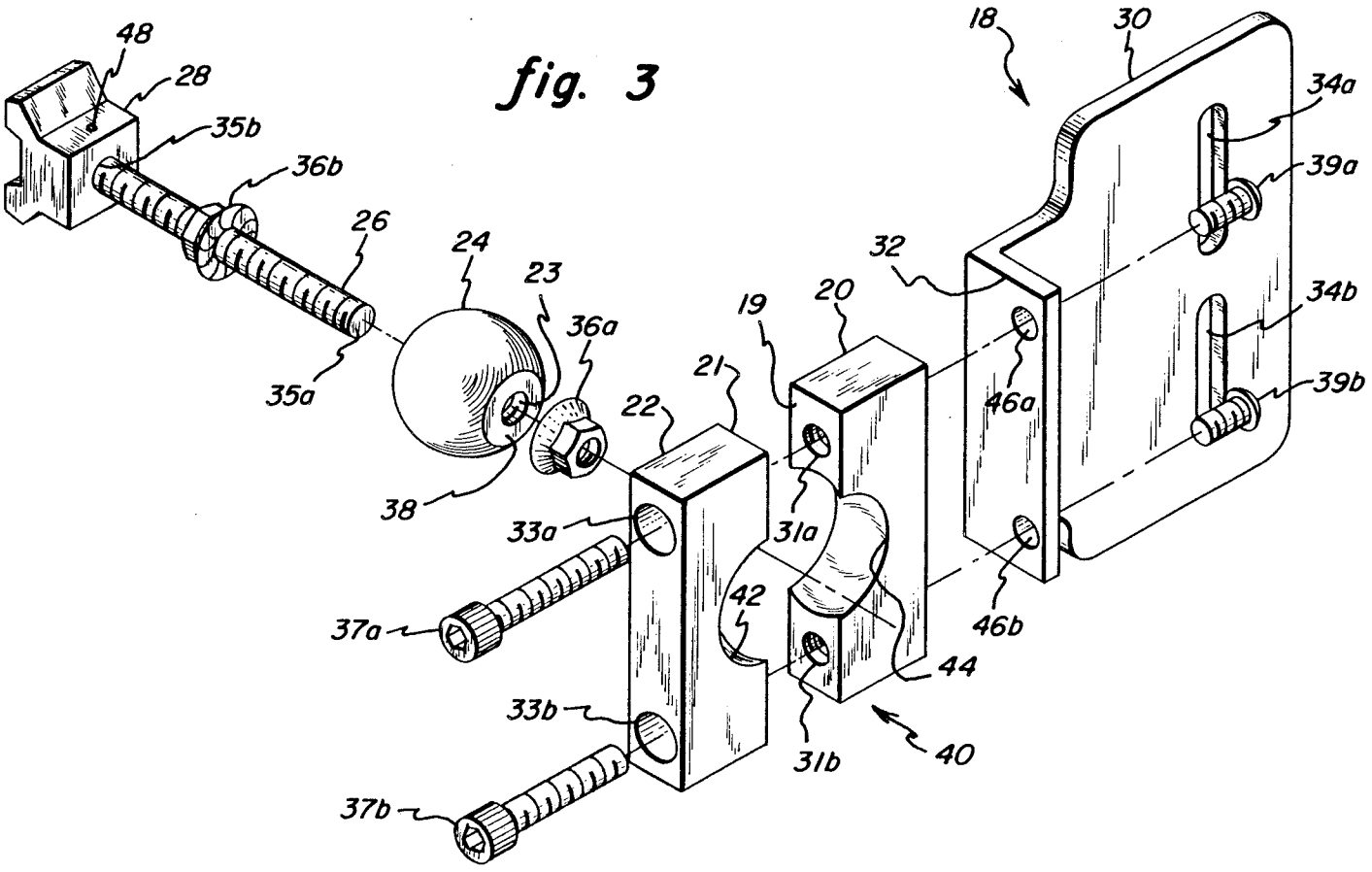
FIG. 3 is an exploded view of the telescope mount depicted in FIGS. 1 and 2.

Referring to the assembled view of the telescope mount presented in FIG. 2 and the exploded view of FIG. 3, the main components of one embodiment of the telescope mount include: a bracket (18), a first member (20), a second member (22), a ball (24) with a threaded hole therethrough (23), a threaded rod (26), and a base clamp (28) which forms part of a clamp means (29) (see FIG. 4) for securing the telescope to threaded rod (26).

Bracket (18) preferably made of a metal, such as aluminum, is L-shaped consisting of a base plate (30) and an arm (32) extending therefrom. Base plate (30) has two slots (34*a* and 34*b*), each of which are sized to advantageously overlie two holes which are typically drilled into the planar midsection of an archery bow for accommodating attachments, such as quiver holder (14) (see FIG. 1), as explained below. The slots (34*a* and 34*b*) are oval in shape and enable bracket (18) to be vertically adjusted relative to bow (12) (bow (12) is depicted in FIG. 1). This adjustment is accomplished by sliding base plate (30) vertically relative to the bow until each of the elongated slots are aligned with a hole in the surface of the archery bow. Once this is accomplished, bracket (18), specifically base plate (30), is secured at the desired location in any conventional manner, such as by screws.

If desired, the two slots (34*a* and 34*b*) and the two holes in the bow's planar midsection may be further used to accommodate quiver holder (14) (as shown in FIG. 1). This is accomplished by aligning the two holes present in quiver holder (14) with the two slots in base plate (30) and then using screws (11*a* and 11*b*) to secure holder (14) and plate (30) to bow (12) via the pre-existing holes in the bow. (See FIG. 1 for an illustration of the above-described attachment.)

Attached to arm (32) is an adjustable clamping means (40). Adjustable clamping means (40) includes two members (20 and 22), which are substantially similar. These two members are attached in such a manner as to engage ball (24). Each member (20 and 22) has an overall C-shaped configuration; that is, each member (20 and 22) preferably is made of a metal, such as aluminum, and is rectangularly shaped with a partial spherical opening (42, 44) in the middle of one side. These partial spherical openings are formed when the edges of openings (42 and 44) are machined to have a surface contoured to mate closely with the shape of ball (24). When the end (19) of first member (20) is attached (as described below) to the end (21) of second member (22), then the contoured surfaces (42 and 44) form an opening sized to receive ball (24).

Two threaded connecting screws (39*a* and 39*b*) which may be, for example, ¼ inch long, are used to connect arm (32) to first C-shaped member (20). This is accomplished by passing connecting screws (39*a* and 39*b*) through bore holes (46*a*, 46*b*) and into sized threaded holes (31*a*, 31*b*) of C-shaped member (20). Attached to C-shaped member (20) is C-shaped member (22). C-shaped member (22) has bore holes (33*a*, 33*b*) each of which has a counter sunk hole sized to receive the head of threaded connecting bolts (37*a*, 37*b*). The threaded bolts are sized, for example, ¾ inch long, to pass through holes (33*a*, 33*b*) and into threaded holes (31*a*, 31*b*) of C-shaped member (20). Threaded holes (31*a*, 31*b*) are smaller than holes (33*a*, 33*b*) since they only have to receive the ends of bolts (37*a*, 37*b*) and not the heads. As mentioned previously, when end (19) of first member (20) is engaged in an abutting relation with end (21) of second member (22), an opening is formed sized to receive ball (24).

As depicted in one embodiment, ball (24), preferably made from a conventional plastic has a radius of approximately one inch and is clampably held by C-shaped members (20 and 22) as described above. Ball (24) has a threaded hole (23) therethrough which is sized to receive threaded rod (26) which may be, for example, ¼ inch in diameter and 2 ¼ inches long. At each opening to the threaded hole (23) on ball (24), there is a flattened area (e.g., 38) and a serrated nut (e.g., 36*a*, 36*b*). Each serrated nut (36*a*, 36*b*) tightens securely against the flattened area (e.g., 38) of ball (24).

Figure 4:
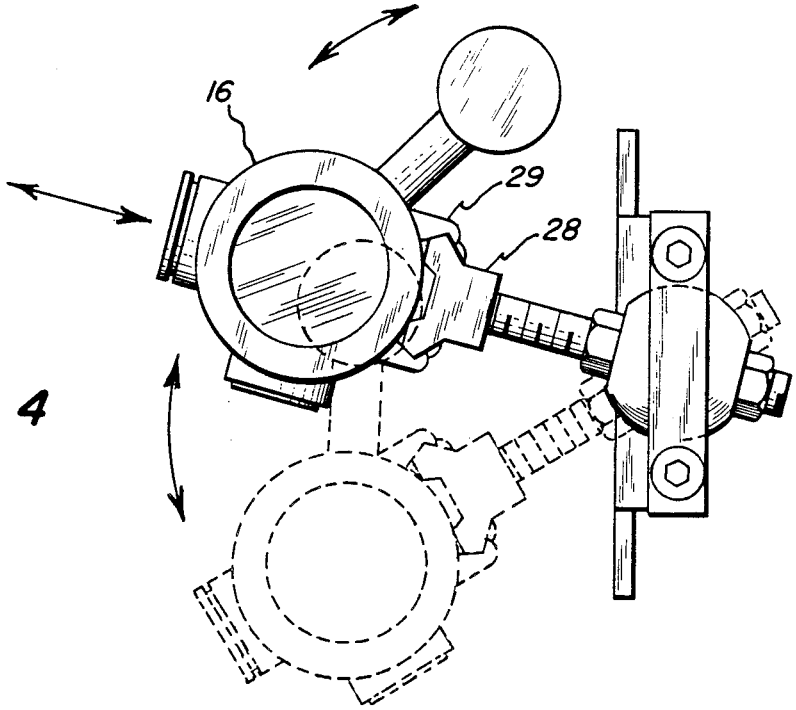
FIG. 4 depicts a side view of the adjustable telescope mount depicted in FIGS. 1, 2, and 3 along with a phantom view of the telescope in an adjusted position.

As previously explained, a first end (35*a*) of rod (26) is threaded through ball (24). As depicted in FIGS. 2 and 3, attached to the second end (35*b*) of threaded rod (26) is clamp means. Clamp means includes a base clamp (28), which is similar to a conventional base used to secure a pistol telescope on a hand held pistol. However, conventional bases are, for example, four and five inches in length, which is unnecessary for the present invention. Therefore, base clamp (28) has been modified by shortening it a few inches. Base clamp (28) has a threaded hole for receiving second end (35*b*) of rod (26). Base clamp (28) also has a pinhole (48) drilled through the two sides which do not have the threaded hole. Pinhole (48) is sized to receive a roll pin which, when in place, immobilizes base clamp (28) on threaded rod (26). As illustrated in FIG. 4 and depicted in one embodiment, the function of base clamp (28) is to secure a telescope in a conventional manner, such as by bolting clamp (28) to a telescope clamp (29) which surrounds and holds telescope (16).

The present invention, one embodiment of which has been described herein, enables the telescope mount to be adjusted in any direction relative to the bow. A gross adjustment may be made when bracket (18) is adjusted vertically with respect to the bow by appropriately aligning the two slots with the two pre-existing holes drilled into the midsection of the archery bow.

A fine adjustment is available by loosening each locking nut (36*a* and 36*b*) and turning threaded rod (26). This adjustment will move the telescope along an axis transverse to the line of sight relative to the bow.

A further fine adjustment is available by loosening threaded connecting bolts (37*a* and 37*b*) and rotating ball (24). (A phantom view depicting this rotation is illustrated in FIG. 4.) This three dimension rotational adjustment permits the telescope to be infinitely adjusted within its spherical range. By loosening just two bolts (37*a* and 37*b*), the telescope can be adjusted slightly or greatly depending on the archer's needs. This three dimension rotational adjustment is not limited by a set positioning notch anywhere within the telescope mount. Therefore, this telescope mount is readily adjustable infinitely within a spherical range.

Although a preferred embodiment has been depicted and described in detail herein, it will be apparent to those skilled in the relevant art that various modifications, additions, substitutions, and the like can be made without departing from the spirit of the invention, and these are therefore considered to be within the scope of the invention as defined in the appended claims.

What is claimed is:

1. A telescope mount for an archery bow, said telescope mount comprising:

(a) a threaded rod, said threaded rod being capable of receiving a telescope at a first end;

(b) a ball having a threaded hole therethrough, said threaded hole being sized to receive a second end of said threaded rod;

(c) means for adjustably clamping said ball, and means for affixing said adjustable clamping means to said bow, whereby when said threaded rod engages a telescope at said first end and said ball at said second end, and said ball is clamped by said adjustable clamping means, and said clamping means is attached to said bow, said telescope has the capability of being adjusted in three dimensions relative to said bow.

2. The telescope mount of claim 1, wherein said means for affixing said adjustable clamping means to said bow includes a bracket.

3. The telescope mount of claim 2, wherein said bracket is L-shaped, said L-shaped bracket having a base plate and an arm extended therefrom, said base plate being configured to be affixed to said bow.

4. The telescope mount of claim 3, wherein said bracket is made from a metal.

5. The telescope mount of claim 3, wherein said base plate has two slots, each of said slots being capable of receiving a screw sized to secure said base plate to said bow, said slots being sufficiently elongate for enabling vertical adjustment of said base plate relative to said bow.

6. The telescope mount of claim 5, further comprising a quiver holder, said quiver holder being capable of attachment to said bow by said screws through said slots.

7. The telescope mount of claim 1, further comprising the telescope and a telescope clamp means, said telescope clamp means being capable of receiving said telescope and securing said telescope to said threaded rod.

8. The telescope mount of claim 7, wherein said telescope clamp means includes a base clamp, said base clamp being attached to said first end of the threaded rod.

9. The telescope mount of claim 8, wherein said threaded rod and said base clamp are made from a metal.

10. The telescope mount of claim 8, wherein said base clamp has a threaded hole sized to receive said threaded rod.

11. The telescope mount of claim 10, wherein said base clamp includes means for immobilizing said threaded rod.

12. The telescope mount of claim 1, wherein said ball is manufactured from plastic and approximately one inch in diameter having a flattened area at each threaded opening.

13. A telescope mount for an archery bow, said telescope mount comprising:

(a) a threaded rod, said threaded rod being capable of receiving a telescope at a first end;

(b) a ball having a threaded hole therethrough, said threaded hole being sized to receive a second end of said threaded rod; and (c) means for adjustably clamping said ball, said adjustable clamping means including a first member and a second member, each member having a partial spherical opening at one end, said members forming an opening sized to receive said ball when said sides of said members having said partial spherical openings are engaged in an abutting relationship, and said adjustable clamping means being adapted to attach to said bow, whereby when said threaded rod engages a telescope at said first end and said ball at said second end, and said ball is clamped by said adjustable clamping means, and said clamping means is attached to said bow, said telescope has the capability of being adjusted in three dimensions relative to said bow.

14. The telescope mount of claim 19, wherein said clamping means includes a first C-shaped member, each C-shaped member having a partial spherical opening at one side, said C-shaped members forming an opening side to receive said ball when said sides of said C-shaped members having said partially spherical openings are engaged in an abutting relation.

15. The telescope mount of claim 14, wherein said partial spherical openings include edges which are machined to have a surface contoured to mate closely to said ball.

16. The telescope mount of claim 14, wherein said C-shaped members are secured about said ball by two connecting bolts.

17. The telescope mount of claim 14, further comprising a bracket for affixing said adjustable clamping means to said bow, said bracket having a base plate and an arm extending therefrom, said base plate being configured to be affixed to said bow, and said arm being capable of being secured to said first C-shaped member by two connecting screws.

18. The telescope mount of claim 16, wherein said C-shaped members are made from a metal.

* * * * *

UNITED STATES PATENT AND TRADEMARK OFFICE

CERTIFICATE OF CORRECTION

PATENT NO. : 4,986,001

DATED : January 22, 1991

INVENTOR(S) : Frank J. Giamattei

It is certified that error appears in the above-identified patent and that said Letters Patent is hereby corrected as shown below:

Col. 6, line 33 "claim 19" should be --claim 13--.

Signed and Sealed this

Ninth Day of November, 1993

*Attest:*

Bruce Lehman

BRUCE LEHMAN

*Attesting Officer*

*Commissioner of Patents and Trademarks*